United States Patent [19]

Rece

[11] Patent Number: 4,480,421

[45] Date of Patent: Nov. 6, 1984

[54] AUXILIARY FLAP SEALER FOR A CARTONING MACHINE

[75] Inventor: Wesley J. Rece, California, Ky.

[73] Assignee: R. A. Jones & Co. Inc., Covington, Ky.

[21] Appl. No.: 349,528

[22] Filed: Feb. 17, 1982

[51] Int. Cl.[3] ..... B65B 7/20; B65B 57/02

[52] U.S. Cl. ..... 53/75; 53/77; 53/374; 53/383

[58] Field of Search ..... 53/374, 377, 383, 75; 118/669; 156/357; 493/31, 131, 142, 331

[56] References Cited

U.S. PATENT DOCUMENTS

| | | | |
|---|---|---|---|
| 3,135,628 | 6/1964 | Johnson | 53/374 X |
| 3,302,365 | 2/1967 | Currie | 53/374 X |
| 3,420,037 | 1/1969 | Villemure | 53/374 X |
| 3,504,978 | 4/1970 | Dieter | 53/374 X |
| 3,872,652 | 3/1975 | LaBantschnig | 53/383 X |
| 3,879,920 | 4/1975 | Langen | 53/374 X |
| 4,380,967 | 4/1983 | Matt | 118/669 |

FOREIGN PATENT DOCUMENTS

| | | | |
|---|---|---|---|
| 2014105 | 8/1979 | United Kingdom | 53/383 |

*Primary Examiner*—John Sipos

*Attorney, Agent, or Firm*—Wood, Herron & Evans

[57] ABSTRACT

An auxiliary flap sealer for a cartoning machine. A conveyor carries cartons past a gluer and then to a normally stationary plow to press together flaps to which glue has been applied. When the conveyor stops, with glue applied to open flaps, the stationary plow and glue nozzles are shifted upstream to complete the glue application if necessary and to close the flaps.

8 Claims, 5 Drawing Figures

AUXILIARY FLAP SEALER FOR A CARTONING MACHINE

This invention relates to a cartoner and more specifically to an auxiliary end flap sealer to complete the gluing and closing of unsealed flaps when the machine shuts down.

The cartoner to which the invention is applied is a conventional one which has been used in the packaging industry for many years. The invention is applicable to cartons which are carried in a horizontal orientation as well as a vertical orientation.

In the packaging of products using such a cartoner, the cartons are erected and delivered into transport lugs which are carried on an endless chain conveyor. At least one end of the carton has open flaps to which a hot melt glue will be applied. Following the application of the hot melt glue, the cartons are carried by the conveyor past a stationary plow mechanism which forces the flaps together and holds them together for a period of sufficient duration to permit the glue to set, thereby closing one end of the carton. The other end of the carton may alternatively have tuck flaps which are closed by conventional mechanism, or, alternatively, the flaps may be of the type which are to be glued and plowed closed.

When the machine stops, glue will have been applied to a flap, or partially applied to a flap, without the flaps having been plowed closed to effect the sealing of that end of the carton. The hot melt glue sets so rapidly that even if the cartoner were to be started up again very shortly after the application of the glue, at best an imperfect seal of the end of the carton would be made. It has been the custom to accommodate this problem by the simple expedient of losing the imperfectly sealed or unsealed cartons.

In a somewhat different environment, this problem has been addressed in connection with a tray packer into which twenty-four cans have been packed. In that environment, the solution to a similar problem of closing flaps to which glue has been applied has been to provide a special mechanism located between the gluer and the flap plow. The special mechanism engages and thrusts the unsealed flap upwardly and holds it against the other flaps to which it is to be sealed. That invention is described in U.S. Pat. No. 3,504,478. That approach to flap sealing, while satisfactory for the rather large corrugated paperboard tray, is not particularly well suited for the sealing of small cartons which are carried rather close together between their transport lugs on the transport conveyor.

The objective of the present invention has been to provide a mechanism to complete the gluing if gluing has been only partially completed and to force and hold the flaps together until the glue sets in order to seal the flaps. With the addition of this mechanism, no cartons are lost because of the problems attending the stopping of the machine as discussed above.

This objective of the invention is attained by mounting the normally stationary plow and the glue nozzle on a slide which can be reciprocated parallel to the movement of the transport conveyor. In the event of the stopping of the conveyor, the glue nozzles are thrust by a piston and cylinder in an upstream direction, that is, counter to the normal movement of the cartons. If glue has been partially applied to a flap, the gluer completes the application. The upstream movement of the plow forces together those flaps to which glue has been applied and holds them together for a period sufficient to effect the sealing of the flaps.

Thus, instead of carrying the cartons past the stationary gluer and plow as in the normal operation of the cartoner, the gluer and plow are moved in an opposite direction past the now stationary cartons during a stoppage of the machine.

The several features of the invention will become more readily apparent from the following detailed description taken in conjunction with the accompanying drawings in which.

Figure 1:
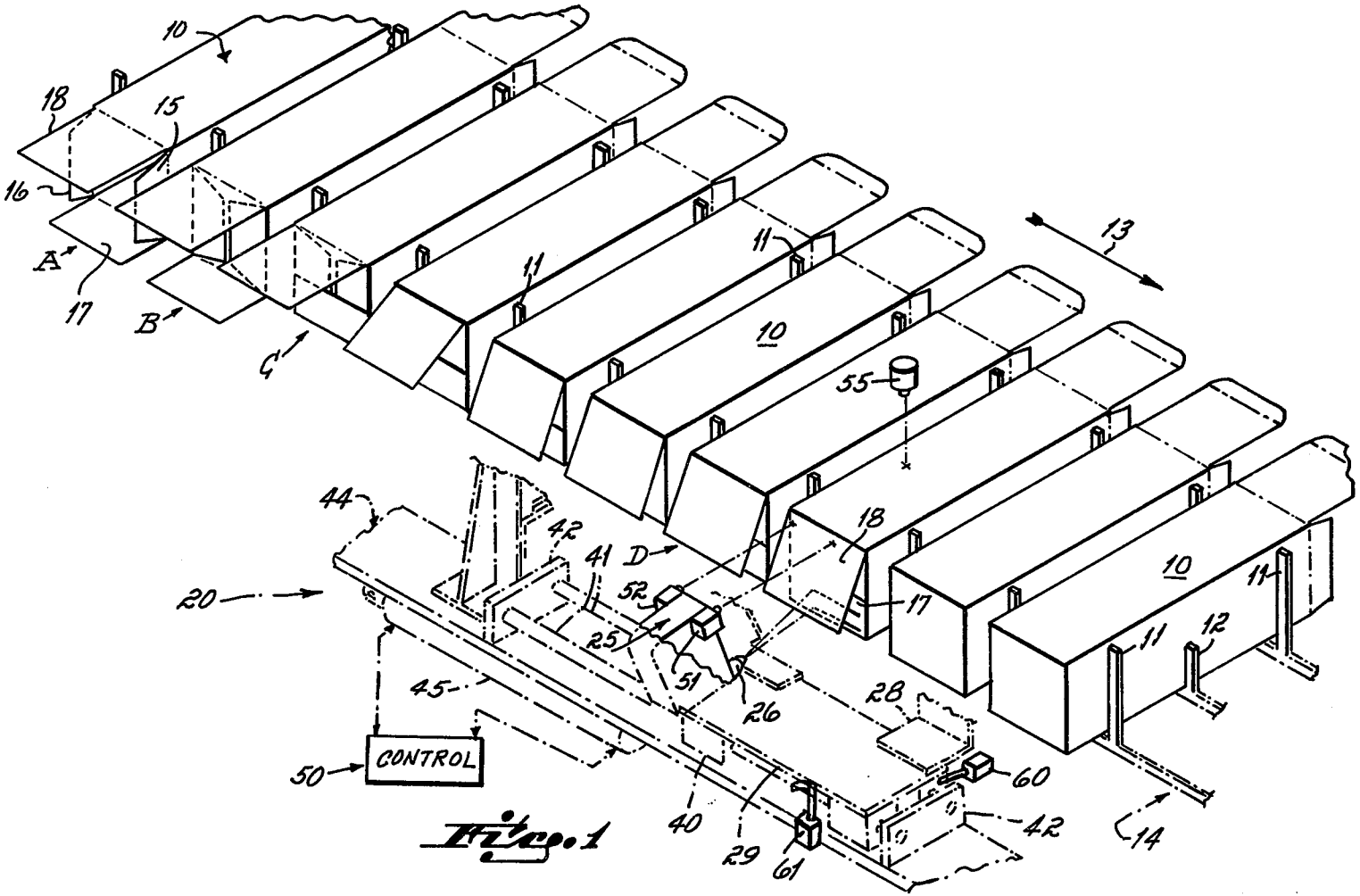
FIG. 1 is a perspective view of a portion of a cartoner to which the invention is applied.

Referring to FIG. 1, a small portion of a conventional cartoner is illustrated in perspective view. Much of the cartoner such as the carton feeding and erecting mechanism and the carton loading mechanism is eliminated, for those mechanisms form no part of the present invention.

Figure 2:
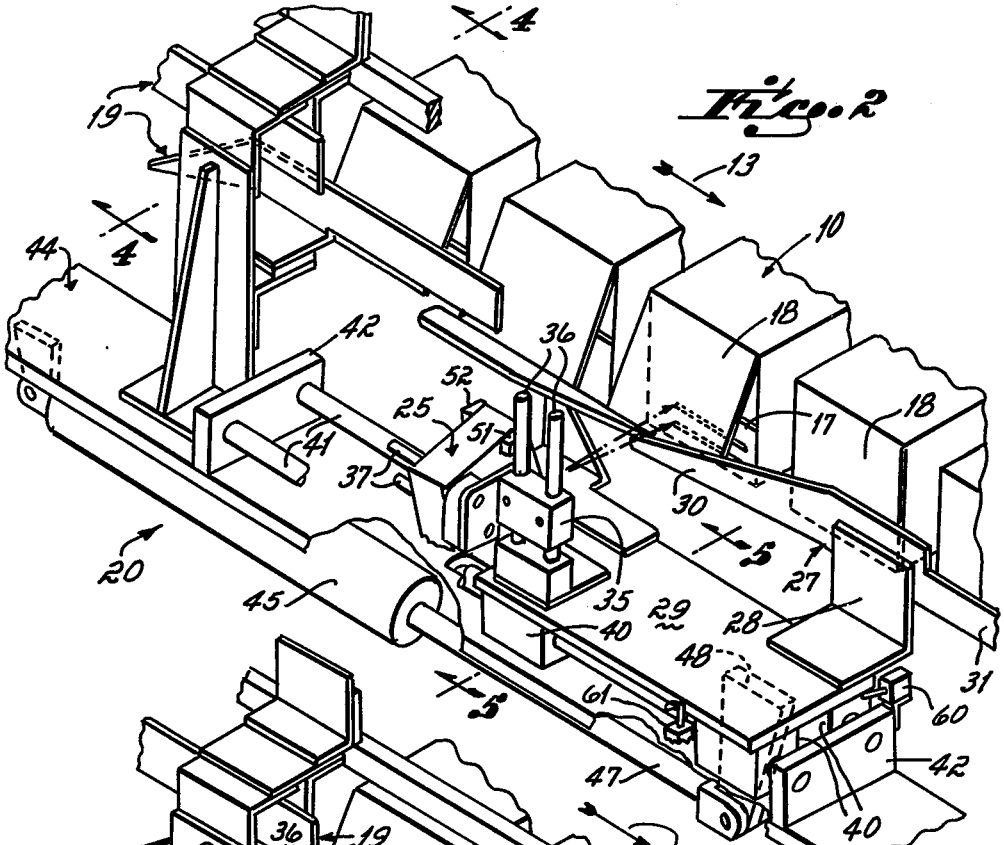
FIG. 2 is a perspective view of the reciprocal plow and gluer of the invention.
Figure 3:
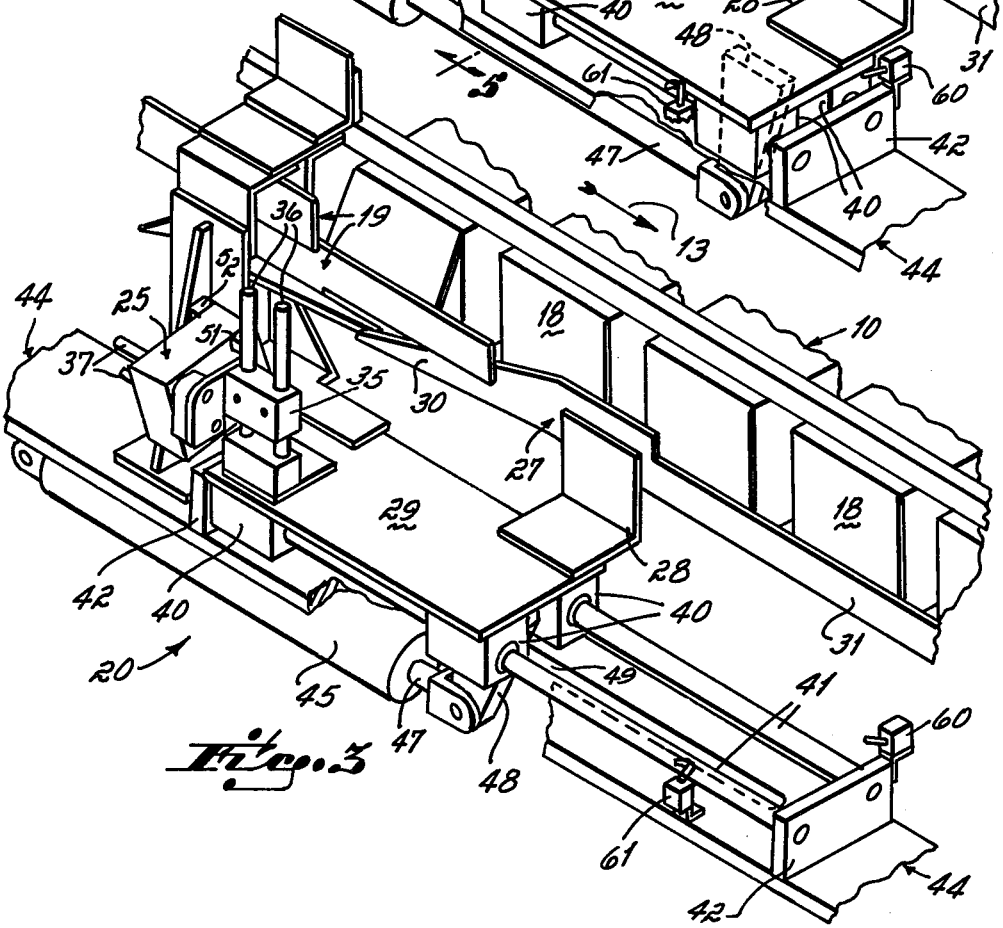
FIG. 3 is a perspective view similar to that of FIG. 2 showing the gluer and plow having been shifted upstream upon the stoppage of the cartoner.
Figure 4:
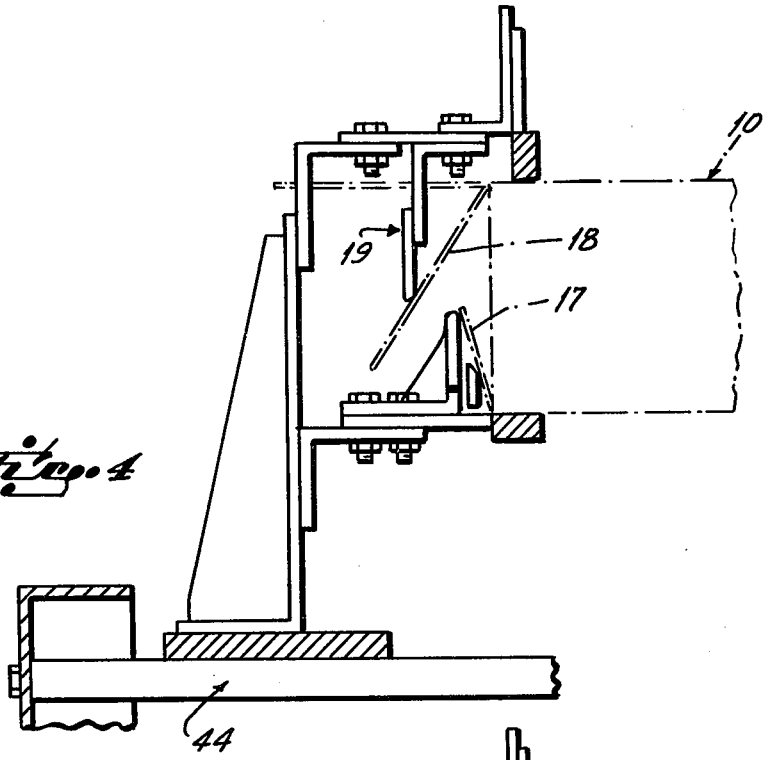
FIG. 4 is a cross-sectional view taken along lines 4—4 of FIG. 2.

As is conventional, cartons 10 are carried between trailing lugs 11 and leading lugs 12 in the direction of the arrow 13 by a conveyor 14. The cartons have inner flaps 15 and 16, a bottom flap 17 and a top flap 18. Conventional flap closing mechanisms are employed to swing the inner flaps 15 and 16 from the position shown at A to a closed position shown at B. Similarly, conventional mechanism is employed to swing the lower flap 17 to a closed position shown at C. Still additional conventional plow mechanism 19 is employed to swing the upper or outer flap 18 to a partially closed position as shown at D. A gluing and plowing station 20 is mounted alongside the transport conveyor 14 to apply glue to the lower flap 17 and to plow the outer flap 18 down upon the lower flap to which the glue has been applied. That mechanism is more completely illustrated in FIGS. 2 and 3.

Figure 5:
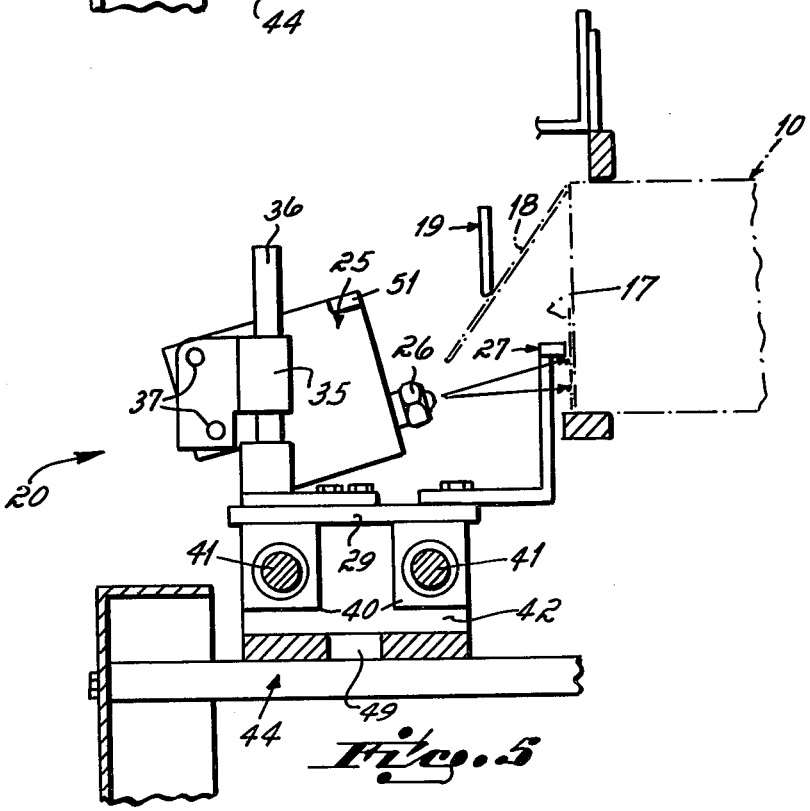
FIG. 5 is a cross-sectional view taken along lines 5—5 of FIG. 2.

The mechanism includes a glue gun 25 having a nozzle 26 (FIG. 5). This glue gun is supplied with hot melt adhesive from a conventional source, not shown.

The mechanism also includes an elongated stationary plow 27 which is mounted by an L-shaped bracket 28 to a support plate 29. The plow 27 has an outwardly-flaring upstream end 30 which first engages the flap 18 to begin the camming of it to a closed position. Downstream of the end 30 is a long bar 31 which serves to hold the flap in a closed position for a period of time sufficient to permit the adhesive to set to the point that a sealed carton is assured.

The glue gun 25 is also mounted on the plate 29. It is secured to a block 35 which is adjustably mounted on two vertical posts 36. Set screws are provided to permit the adjustment of the vertical orientation of the glue nozzle to permit the cartoner to be changed over to different types of cartons. The gun is also mounted on a pair of horizontal posts 37 so that its longitudinal position with respect to the stationary plow 27 can be changed for similar change-over purposes.

The plate 29 is mounted at its four corners onto bearing blocks 40, the bearing blocks in turn being mounted on a pair of horizontal rods 41. The rods 41 are supported by brackets 42 to the machine frame 44. A double-acting pneumatic cylinder 45 is mounted on the machine frame 44. The cylinder carries a piston having a rod 47 which is connected by an arm 48 through a slot 49 in the frame 44 to the plate 29 to cause the plate to reciprocate between the normal operating position illustrated in FIG. 2 and the upstream position illustrated in FIG. 3.

The gluer and piston and cylinder are operated by a control system 50. The control system includes a pair of electric eyes 51 and 52 which are carried on the glue gun. The function of the electric eyes is to detect the position of a carton 10 with respect to the gluer nozzle 26 to determine whether glue has been partially or completely applied. If glue is partially applied when the machine is stopped, the control system will continue the application of glue as the assembly is shifted in an upstream direction until glue is completely applied to the lower flap 17.

The electric eye 51 operates through the control system to fire the glue gun when the leading edge of a carton is detected. The position of the glue gun nozzle 26 with respect to the flap 17 is such that when the gun is triggered, the application of glue will begin a fraction of an inch inboard of the leading edge of the flap 17.

The upstream electric eye 52 controls the stopping of the application of glue. When it detects the trailing edge of the carton, it causes the glue gun to shut down. Its relationship to the nozzle 26 is such that the application of glue to the flap 17 will terminate a fraction of an inch inboard of its trailing edge. The electric eyes 51 and 52 are operable to control the glue gun during operation when the cartoning machine has stopped and the auxiliary sealing operation takes place. In normal operation, the glue gun is activated by a programmed timer initiated by a third electric eye 55.

The electric eye 55 is mounted over the cartons. It detects the presence or absence of a carton underneath it. When it detects the presence of a carton, it causes the control circuit 50, including the starting of the programmed timer, to apply glue during the normal operation of the cartoner. If the cartoner stops and the electric eye is positioned over a space between the cartons, it deactivates the gluer portion of the control system so that no additional glue is applied as the assembly is shifted in an upstream direction.

During startup, the electric eye 55 is programmed to ignore the first carton so as to avoid the application of glue to a carton which has been sealed by the auxiliary sealing procedure. In other words, the gun will not fire until the electric eye 55 sees a gap and resets itself. Thereafter, when the electric eye 55 sees each succeeding carton, it, working through the programmed timer, will fire the gun.

A pair of microswitches 60 and 61 are mounted on the machine frame 44. Microswitch 60 is engageable by the support plate 29 to detect its location in the normal operating position. The cartoning machine will not operate unless that microswitch has been contacted so as to provide assurance that the glue gun and plow are in the proper position for normal operation. The microswitch 61 is engageable by the support plate 29 and controls the operation of the glue gun to keep it firing during normal operation. When the switch 61 is engaged by the plate 29, the gun can fire. When the plate 29 is moved upstream during the auxiliary procedure, it will be disengaged from the switch 61 after a limited portion of its travel. When disengaged, the glue gun will not be able to fire. Thus, during the auxiliary procedure, the carton which is partially glued may have a complete application of glue. As the support 29 continues to move upstream to permit the flap 18 to be plowed to a sealed position, the disengagement of microswitch 61 from the support plate will prevent the glue gun from firing toward the next upstream carton.

In the operation of the invention with the cartoner running normally, the respective flaps on the end of the carton are plowed to the positions illustrated in FIG. 1 as the cartons move in the direction of the arrow 13 toward the gluing and plowing station. Glue is applied by the gun 25 in a horizontal line on flap 17, the line terminating just short of the leading and trailing edges of that flap. As the cartons move past the stationary plow 27, the flap 18 is plowed down against the flap 17 and held there by the downstream bar 31 and other downstream rails for about three seconds until the glue sets sufficiently to assure a sealed carton.

When the stop button is pushed, the cartoner will stop. A timing circuit will pause for a second or two before activating the piston and cylinder combination 45. A solenoid-operated valve will admit air under pressure into the cylinder to drive the piston and the support plate in an upstream direction. The timing circuit will then permit the support plate to remain at rest in its upstream position for about two to three seconds after which the valves will shift the application of air to the cylinder to drive the support plate back to its original normal operating position.

When the machine stops, it will stop in one of two conditions of application of glue. Either the glue will be partially applied to the flap 17, or the glue will have been completely applied to the flap 17. This will be determined by the position of the carton with respect to the electric eye 55. In the first condition of partial application of glue, upon machine stoppage, the piston and cylinder combination 45 will be activated to thrust the plate 29 carrying with it the gun 25 and plow 27 in an upstream direction. During this movement, the application of glue to the flap 17 will be completed and flap 18 will be plowed down upon it to complete the sealing of the end of the carton.

In the second condition of complete application of glue to the flap 17, when the machine stops the piston and cylinder will be activated to shift the plate 29 in an upstream direction. No glue will be applied, but the plow 27 will be effective to complete the sealing of that carton.

At startup, the reciprocal mechanism will be first shifted to its normal operating position so as to be in a position to apply glue to the next oncoming carton for normal operation.

Having described my invention, I claim:

1. In a cartoning machine having a continuously moving conveyor for carrying cartons having end flaps, a glue station wherein glue is applied to at least one carton end flap, and a plow downstream of said glue station to engage and press an end flap against other end flaps to seal the end of a carton as it is carried by said conveyor past said plow, the improvement comprising, a mechanism for sealing at least one carton immediately upstream of said plow when said conveyor is stopped, said plow being the sole means to fold said flaps during the operation and during the stoppage of the conveyor, comprising, a longitudinally movable support on which said plow is mounted, a piston and cylinder connected to said support for moving said plow upstream, control means for sensing the stoppage of the conveyor and in response thereto for causing said piston and cylinder to move said support upstream to close said flaps to which glue is applied.

2. A cartoning machine as in claim 1 further comprising, means for moving said glue station with said plow.

3. A cartoning machine as in claim 2 further comprising means for applying glue to a stationary carton as said plow moves upstream to close said flaps.

4. In a cartoning machine having a continuously moving conveyor for carrying cartons having end flaps, a flap sealing mechanism comprising, a support mounted for reciprocation alongside said conveyor, a piston and cylinder for moving said support between first normal operating downstream position and a second conveyor stopped upstream position, a glue gun mounted in an upstream position on said support to apply glue to one of said flaps, an elongated plow mounted in a downstream position on said support to engage and hold said flaps together to cause the glue to set to seal a carton, said plow being the sole means to fold said flaps during the operation and during the stoppage of the conveyor, and control means for sensing the stoppage of the conveyor and in response thereto for causing said piston and cylinder to move said support to an upstream position to cause the application of glue as needed and to plow closed the flaps of a carton to which glue has been applied.

5. A cartoning machine as in claim 4 further comprising electric eyes to detect whether glue has been partially applied to a carton flap upon stoppage of said machine, said electric eyes being connected to said control means to continue the application of glue as said support moves to said second position if glue has been partially applied when said cartoning machine stops.

6. A cartoning machine as in claim 5 in which said electric eyes comprise, a start eye detecting the presence of the leading edge of said carton to start the application of glue to a partially glued carton, and a stop eye detecting the passage of the trailing edge of a carton to discontinue the application of glue.

7. A cartoning machine as in claim 6 further comprising, switch means for disabling said glue gun after said support has moved upstream a preselected distance to prevent application of glue to a second carton during stoppage of the machine.

8. A cartoning machine as in claim 4 further comprising an electric eye which detects the presence of a carton in a position for application of glue and thereafter causes the application of glue to a carton.

* * * * *